US011852426B2

(12) United States Patent
Cole

(10) Patent No.: US 11,852,426 B2
(45) Date of Patent: Dec. 26, 2023

(54) BARREL BUSHING

(71) Applicant: Sig Sauer, Inc., Newington, NH (US)

(72) Inventor: Jesse D. Cole, Newmarket, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/655,658

(22) Filed: Mar. 21, 2022

(65) Prior Publication Data

US 2023/0296340 A1 Sep. 21, 2023

(51) Int. Cl.

| | |
|---|---|
| ***F41A 11/00*** | (2006.01) |
| ***F41A 21/32*** | (2006.01) |
| ***F41A 5/04*** | (2006.01) |

(52) U.S. Cl.

CPC ..... *F41A 11/00* (2013.01); *F41A 5/04* (2013.01); *F41A 21/32* (2013.01)

(58) Field of Classification Search

CPC ..... F41A 5/04; F41A 11/00; F41A 21/32

USPC ..... 89/196

See application file for complete search history.

(56) References Cited

U.S. PATENT DOCUMENTS

| | | | | |
|---|---|---|---|---|
| 3,158,064 | A * | 11/1964 | Charron | F41A 25/22 89/196 |
| 3,435,727 | A * | 4/1969 | Miller | F41A 25/22 89/196 |
| 3,564,967 | A * | 2/1971 | Violette | F41A 25/22 89/163 |
| 5,952,602 | A * | 9/1999 | Gussalli Beretta | F41A 25/22 89/196 |
| 6,318,231 | B1 * | 11/2001 | Kart | F41A 25/22 89/187.01 |
| 8,453,555 | B1 * | 6/2013 | Karfiol | F41A 5/04 89/163 |
| 10,184,738 | B1 | 1/2019 | Kellgren | |
| 2004/0144245 | A1 * | 7/2004 | Wonisch | F41G 1/26 89/196 |
| 2016/0138882 | A1 * | 5/2016 | Curry | F41A 5/04 89/14.05 |

OTHER PUBLICATIONS

Safety, Instruction & Parts Manual, KelTec, P17, Nov. 2019.

* cited by examiner

*Primary Examiner* — Bret Hayes
(74) *Attorney, Agent, or Firm* — Finch & Maloney PLLC

(57) ABSTRACT

A firearm including a barrel bushing is disclosed. The barrel bushing provides for guidance of the slide without a need for forward rails. The barrel bushing is retained by a bushing stop that allows the slide to be removed while the recoil spring and bushing are retained on the barrel.

25 Claims, 6 Drawing Sheets

BARREL BUSHING

TECHNICAL FIELD

This disclosure relates to firearm components and more particularly to a barrel bushing for retaining and interacting with the slide of the firearm.

BACKGROUND

Traditionally, semiautomatic handguns have been made with a metal frame that includes the grip portion and a body portion with rails along a top surface. The grip portion defines a magazine well into which a magazine is installed. Some semiautomatic handguns have a polymeric grip module that retains a metallic receiver in an open top of the grip module, where the receiver houses the fire control components and includes rails for the slide. Whether a metal frame or a polymeric grip module with drop-in receiver, a slide mounts to and can reciprocate longitudinally along rails that extend along the top of the frame or receiver. A recoil spring surrounds the barrel and provides a return force to the slide to complete the firing cycle.

SUMMARY

Disclosed herein is a firearm that includes a barrel bushing that provides for smooth action of the slide as well as easy field stripping and reassembly of the firearm. The ring-shaped bushing surrounds the barrel and is biased by the recoil spring into a cone feature on the inside of the slide. The barrel guides the movement of the slide. A bushing stop retains the bushing and recoil spring on the barrel when the slide is removed. The slide is pivotable around the bushing so that the rear of the slide can be removed while retaining contact in front.

The figures depict various embodiments of the present disclosure for purposes of illustration only. Numerous variations, configurations, and other embodiments will be apparent from the following detailed discussion.

DETAILED DESCRIPTION

In one aspect a barrel bushing is disclosed. The barrel bushing can be configured to slide along the barrel of the handgun and to guide the action of the handgun slide. The barrel bushing can be ring shaped and can encircle the barrel. It can retain the recoil spring on the barrel and is itself retained on the barrel by a bushing stop that is connected to the end of the barrel. The front portion of the slide of the handgun need only be in contact with the barrel bushing in order to maintain a smooth action during firing. The front half of the slide can be free of direct contact with the frame (or grip) of the firearm. The interface between the slide and the bushing can be, for example, a ball and socket or ball in cone arrangement where the convex bushing is forced into the inner cone shaped surface of the slide by the recoil spring. No connectors are required to keep the slide in contact with the bushing or, indirectly, the barrel. In the absence of the force provided by the recoil spring, the slide would freely move away from the bushing and the barrel. However, when the bushing is biased against the slide by the recoil spring, the slide is well aligned with the barrel and provides for longitudinal action. When the rear of the slide is released and pivoted upwards, the slide can be removed by simply sliding the opening in the front of the slide over the end of the barrel. No screws, set screws, pins or catches need to be released, and there are no tools required in order to remove the slide. The frame requires no forward rails to guide the slide as the barrel itself serves as a guide for the slide. After removal of the slide, the barrel bushing and recoil spring are captive on the barrel as they are retained by the bushing stop. This allows the user to field strip (disassemble) the handgun without the recoil spring or the bushing being separated from the barrel. The barrel, recoil spring, bushing and bushing stop all remain intact, allowing for easier reassembly of the firearm.

The barrel bushing, bushing stop and slide, as described herein, can be used as components for firearms such as semiautomatic handguns, for example hammer-fired and striker fired handguns. In accordance with some example embodiments, the semiautomatic handgun can be chambered in popular calibers including .22 LR, .380 Auto, 9 mm Luger, .357 SIG, 10 mm Auto, .40 S&W, .45 ACP ammunition, or any other suitable ammunition.

Figure 1:
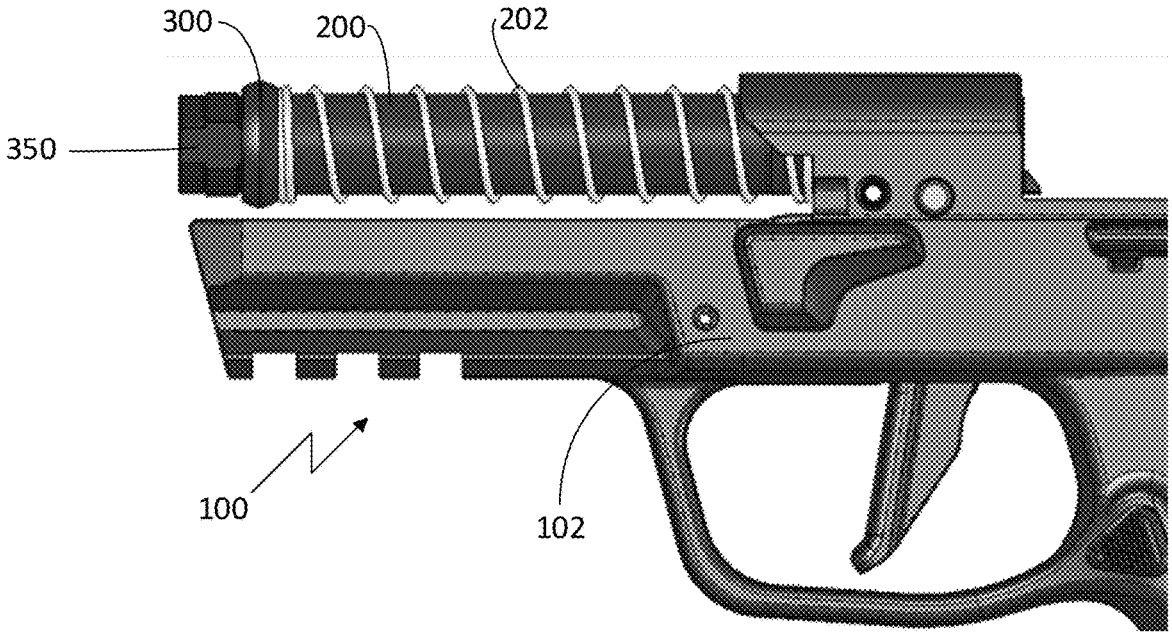
FIG. 1 provides a side view of a handgun with portions removed to show the barrel, recoil spring, barrel bushing and bushing stop of one embodiment.

FIG. 1 provides a cutaway view of one embodiment of a barrel bushing and excludes the handgun slide, for clarity. Shown is handgun 100 that includes frame 102 and barrel 200. Recoil spring 202 is in compression around barrel 200 and is supported at its proximal end by frame 102 and at the distal end by barrel bushing 300. Barrel bushing 300 is retained by bushing stop 350, in this case a thread protector that screws onto threads at the distal end of barrel 200. A top down, closer view of the barrel bushing is provided in FIG. 2. In addition to the components of FIG. 1, FIG. 2 also illustrates subsections of the bushing stop 350 and the barrel bushing 300.

Figure 2:
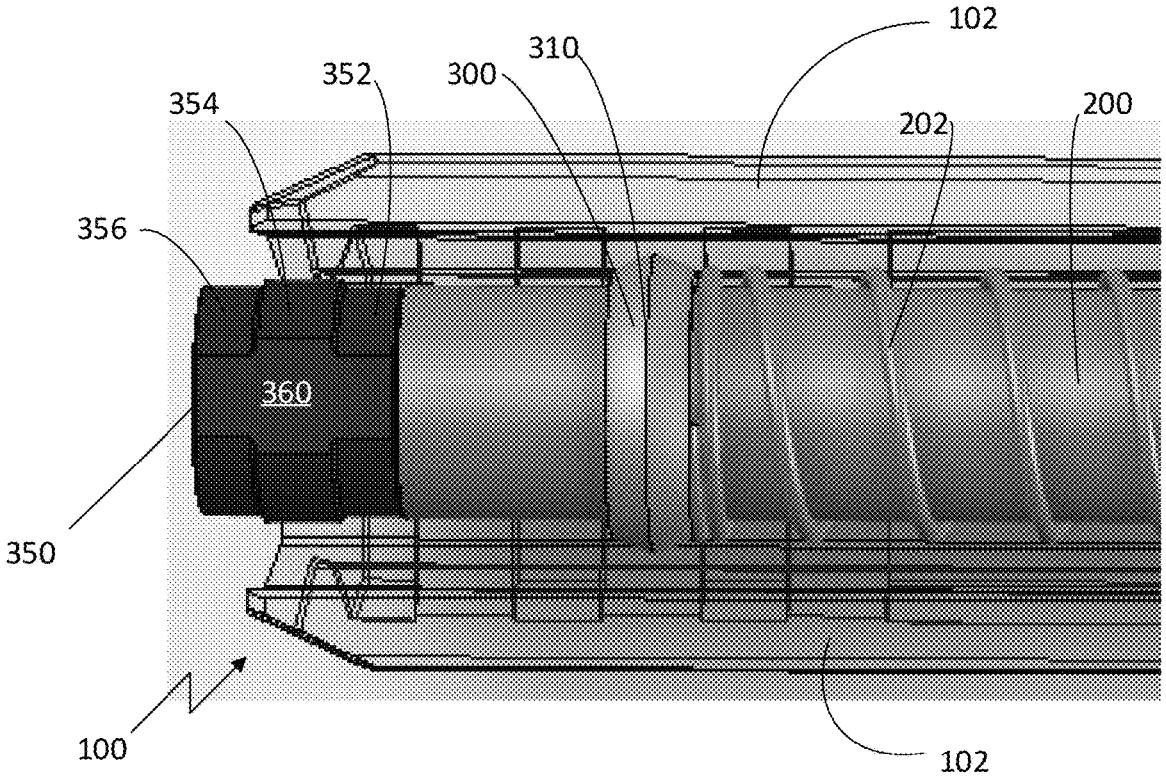
FIG. 2 provides a top down view of the muzzle end of the embodiment of FIG. 1.
Figure 3A:
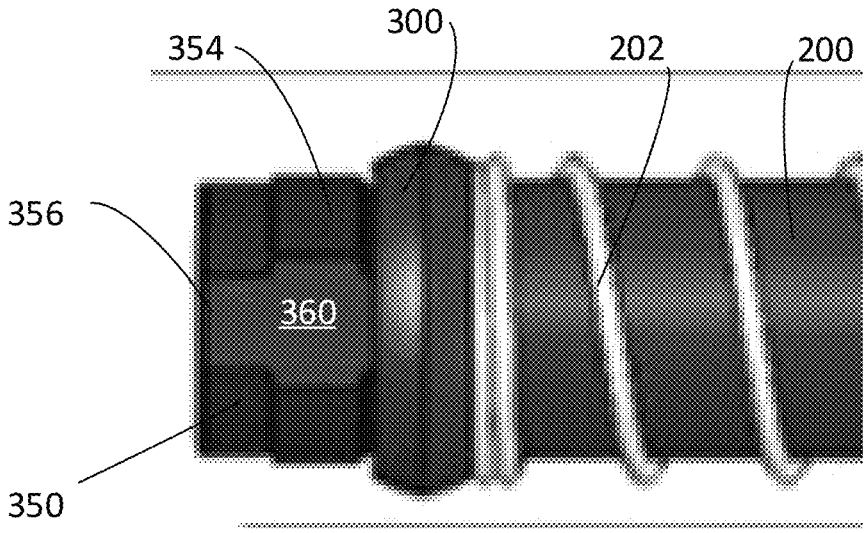
FIG. 3A provides a view of the embodiment of FIG. 2 in a different position.
Figure 3B:
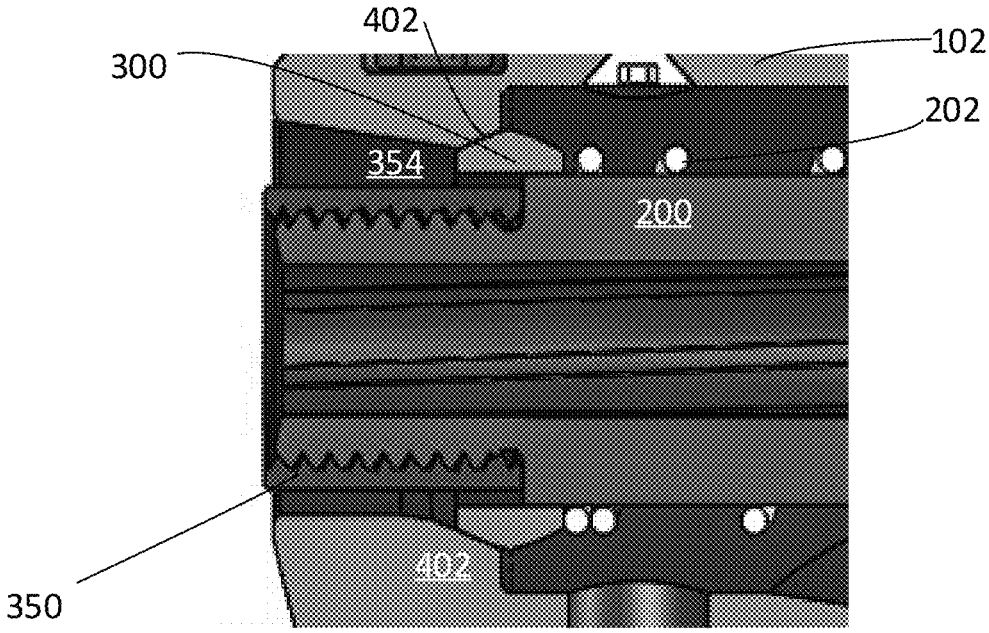
FIG. 3B provides a cross-sectional view of the embodiment of FIG. 2.

The bushing stop is a structural feature removably attached to the barrel. The bushing stop can be retained by complementary threads on the barrel and can be removed by hand or with simple tools. The bushing stop retains the bushing and recoil spring when the slide is removed. In different embodiments the bushing stop can be a component that serves exclusively to retain the bushing, or it can serve multiple functions such as retaining the bushing and as a connector to attach addition components. Examples of bushing stops can include thread protectors, suppressor adapters, adapters for compensators, adapters for barrel weights, adapters for flash hiders, or adapters for other firearm muzzle devices. As shown, bushing stop 350 includes proximal portion 352, central portion 354 and distal portion 356. Shown in FIG. 3B are internal threads that mate with external threads on the distal end of barrel 200. Bushing stop 350 can be sized so that when fully threaded onto the barrel the distal end of bushing stop 350 is even with the distal end of barrel 200. Proximal portion 352 has an outer diameter that is less than or equal to the outer diameter of the barrel and the inner diameter of the barrel bushing. This allows the barrel bushing to slide over the proximal portion 352. Central portion 354 however has at least one portion (a stop) that exhibits a diameter greater than the inner diameter of the barrel bushing, preventing the barrel bushing from advancing when it is not seated in the slide. As a result, barrel bushing 300 retains the recoil spring 202 on barrel 200 in the absence of the slide. Central portion 354 also includes wrench flats 360 that can provide purchase to a wrench for installing and removing the thread protector (bushing stop 350). The wrench flat(s) may extend to the proximal and distal portions of thread protector 350 or may be on only a portion of bushing stop 350. Note that opposed wrench flats may form a section in which the diameter is less than the inner diameter of the barrel bushing 300, but that at least one portion of the bushing stop will have a diameter large enough to prevent passage of the barrel bushing. The view in FIG. 2 shows the barrel bushing in a partially withdrawn position with the recoil spring 202 less than fully extended. This positioning allows for a full profile view of bushing stop 350. FIG. 3A provides a similar view but barrel bushing 300 is fully forward, covering proximal portion 352 of the bushing stop 350. As shown in FIG. 3A, barrel bushing 300 is retained by bushing stop 350 and will not slide off the barrel without removal of bushing stop 350. FIG. 3B provides a cross-sectional view when the slide is fully forward, and the firearm is in battery. In FIG. 3B the threaded interface between the barrel and bushing stop can be seen. In the embodiment of FIG. 3B, barrel bushing 300 is retained by conical seat 402 that is integral to slide 102. Barrel bushing is close to the stop on bushing stop 350 but is not in contact with it as shown.

The barrel bushing is configured and arranged to slide up and down the barrel while retaining the recoil spring at one end and interfacing with the slide at the other. The barrel bushing can be a circular ring. The bushing stop acts as a retainer for the bushing when the slide is removed. The inner surface of the bushing, which contacts the barrel surface, can be flat as on the inside surface of a wedding band or can be ridged or include concave portions. The bushing can have an inner diameter that is equal to or larger than the diameter of the barrel. In various embodiments, the inner diameter of the bushing is larger than the diameter of the barrel by an amount that is less than 0.050 inch, less than 0.025 inch, less than 0.010 inch or less than 0.005 inch. In specific examples, the inner diameter of the bushing is 0.004 inch greater than the outer diameter of the barrel. For example, a barrel having a nominal outer diameter of 12.075 mm can be paired with a bushing having a nominal inner diameter of 12.17 mm.

Figure 4:
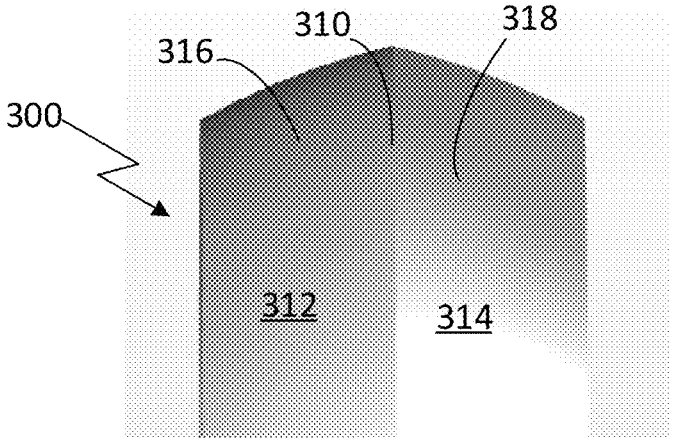
FIG. 4 provides a profile view of one portion of a bushing.

As illustrated in the figures, barrel bushing 300 can be a complete ring that surrounds the barrel. In various embodiments, however, the bushing can be a partial ring or include a break or opening. FIG. 4 provides a closer view of a portion of barrel bushing 300, from the same point of view as that provided in FIG. 3A. In FIG. 4, virtual line 310 represents an imaginary equatorial line that divides the barrel bushing into two portions, a distal portion 312 and a proximal portion 314 (see FIG. 4). Distal portion 312 faces the muzzle and proximal portion 314 faces the chamber. As shown, distal portion 312 and proximal portion 314 are symmetrical although they need not be. For example, barrel bushing 300 could consist entirely of distal portion 312, with a flat vertical surface at line 310. In other embodiments, proximal portion 314 may drop off at a steeper or shallower angle than the proximal portion.

Figure 5A:
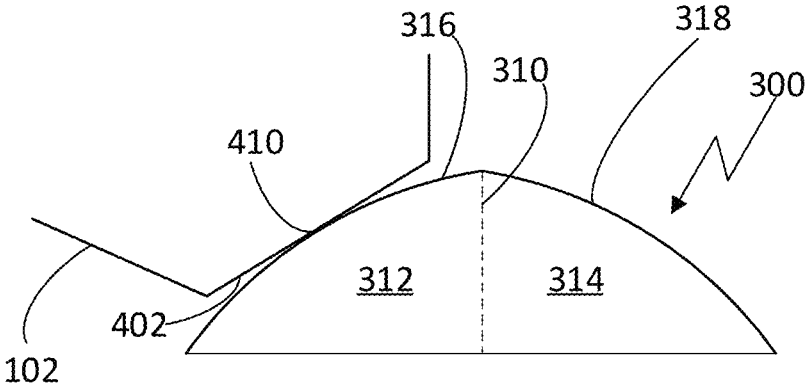
FIGS. 5A and 5B show schematically the interaction of the bushing and the slide in one embodiment.
Figure 5B:
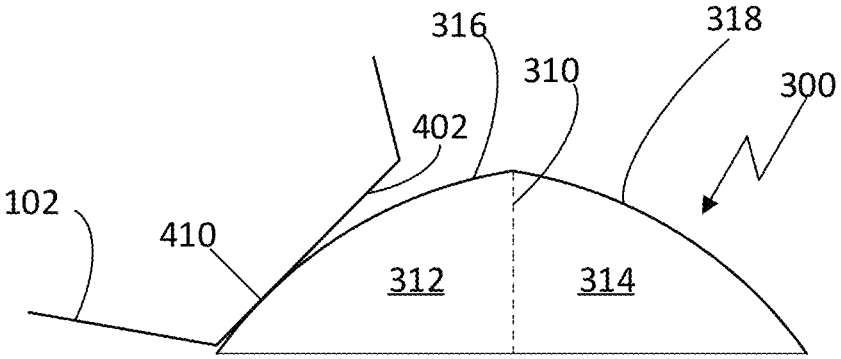

As shown in FIG. 4 and more clearly in the cross-sectional drawings of FIGS. 5A and 5B, distal surface 316 of barrel bushing 300 can have a curved surface and can be convex. In some embodiments, surface 316 can be a spherical segment. As used herein, a spherical segment is used according to its geometrical meaning and is a slice taken from a sphere. The amount of curvature in the spherical segment is a function of the radius of the sphere, and the greater the radius of the sphere, the less curvature in a given length of segment. The steepness, or angle, of the segment is a function of where in the segment it is drawn from and would be steep if taken near the equator of the sphere and shallow if taken near the poles. In various embodiments the barrel bushing can have a spherical segment surface that is from a sphere having a radius of greater than 1 cm, greater than 5 cm, greater than 10 cm, greater than 50 cm, greater than 1 m or greater than 5 m. In these and other embodiments, the radius can be less than 100 m, less than 50 m, less than 10 m or less than 1 m.

Figure 6:
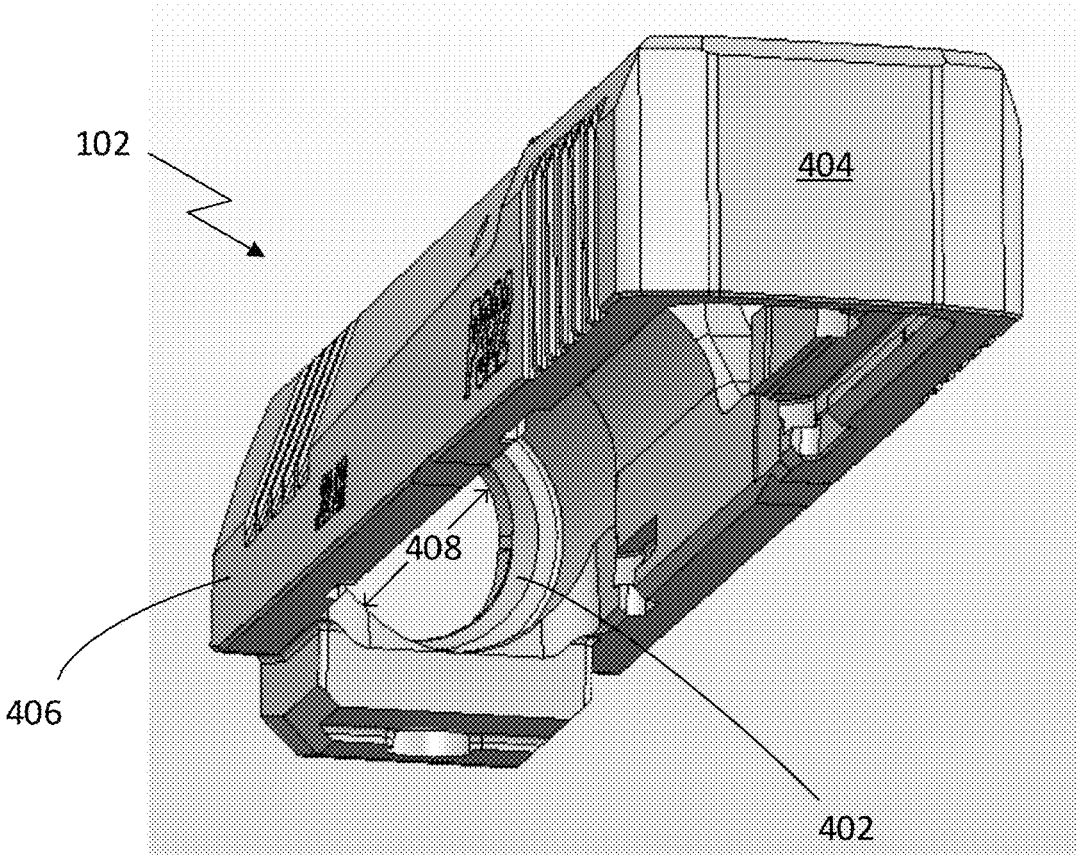
FIG. 6 provides a profile view of the slide of one embodiment.
Figure 8A:
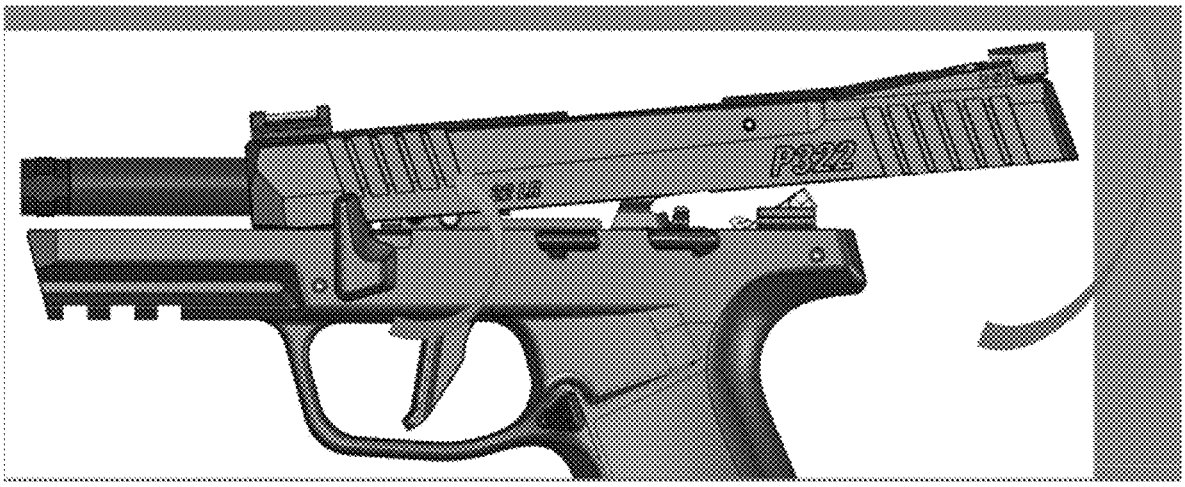
FIGS. 8A through 8D provide a sequence for removing the slide, in one embodiment.

In addition to barrel bushing 300, FIG. 5A shows a portion of slide 102 that contacts barrel bushing 300. Conical seat 402 is most easily seen in FIG. 6 and comes into contact with barrel bushing surface 316 at point 410 (in two dimensions). In three dimensions, inner conical seat 402 presents a circular slice of a cone that forms a circle of contact with barrel bushing surface 316. At point 410, the circumference of conical seat 402 is equal to the circumference of barrel bushing 316 at point 410. This allows the bushing and slide to interface in a ball and cone arrangement that provides for low friction pivoting of the slide about the bushing. Although pivoting can occur in all directions, vertical pivoting is the most useful in assembling and disassembling the handgun. Barrel 200 passes through opening 408 in the slide. The pivotability of the bushing/cone interaction provides for increased maneuverability of the slide and can allow barrel opening 408 to be narrower than it otherwise would need to be. For example, opening 408 can have a diameter that is larger than the outer diameter of the barrel by less than 50%, less than 25%, less than 15% or less than 10%. FIG. 5B illustrates the same components as in 5A except that slide 102 has been pivoted on the bushing by lifting rear slide portion 404 (FIG. 6 and FIG. 8A). The conical seat 402 of slide 102 is still securely retained by barrel bushing 300 even though the angle of the slide has been changed in relation to barrel 200 and in relation to the barrel bushing 300. The force provided by recoil spring 202 keeps the bushing in contact with the conical seat 402 as the slide is pivoted. This allows for removal of the slide without lifting the front portion of the slide off the barrel. Frame rails to guide the slide can be short and located only at the proximal portion of the frame. For instance, the frame rails may have a length of less than ½, less than ⅓ or less than 1% the length of the frame. These frame rails can start at the rear of the frame and extend forward for less than two inches, less than one inch or less than half an inch.

The barrel bushing can be made out of any material that allows it to slide on the barrel and support the recoil spring. The material should be able to withstand the temperature and environment that are encountered in the field. For example, the bushing can be comprised of metals such as steel, aluminum or bronze. In other cases, the bushing can be made of a polymer such as thermopolymers, ABS, polyamide, acrylonitriles, polyurethanes and fluoropolymers. It can be reinforced with a reinforcer such as glass fibers or carbon fibers. Methods of manufacture include machining, die casting, cold finished extrusion, injection molding, polymer extrusion and additive manufacturing.

Figure 7:
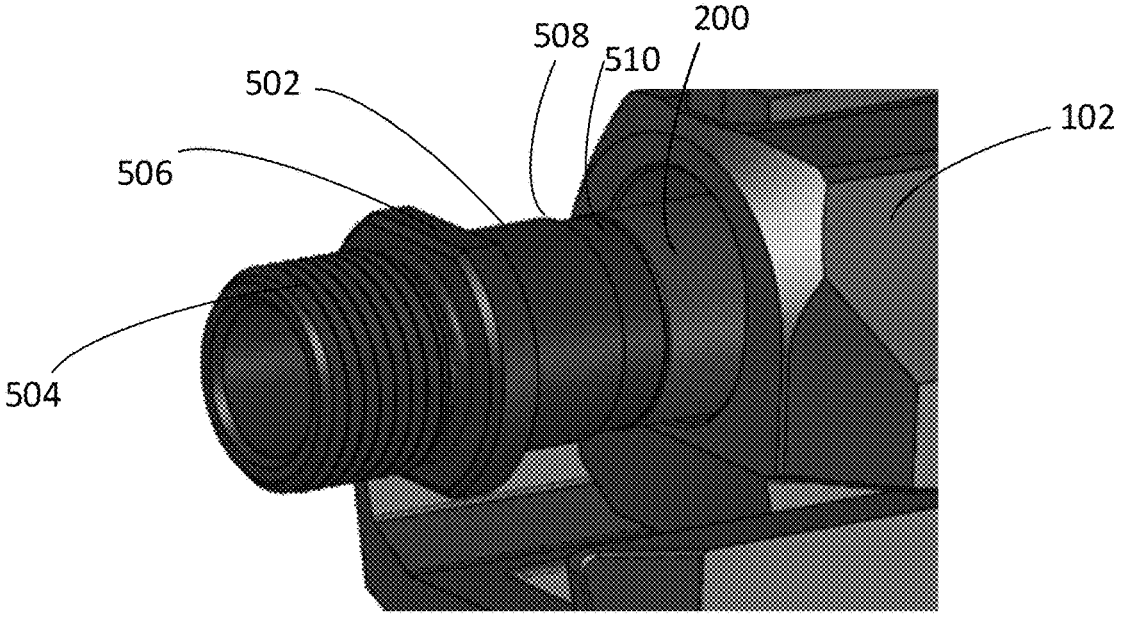
FIG. 7 provides a profile view of one embodiment of a bushing stop.

The system described herein can be modular, and components such as the thread protector can be added to or swapped out for other bushing stops that increase the adaptability of the firearm. For example, as shown in FIG. 7, parts such as a suppressor adaptor 502 can increase the functionality of the system. Adaptor 502 can include threads (not shown) that allow the adaptor to be connected to barrel 200 in the same way as a thread protector is. Suppressor adaptor 502 includes external threads 504 for connecting to a suppressor, for example. Like the thread protector 350, suppressor adaptor 502 includes proximal portion 510 that allows for axial movement of barrel bushing 300, stop 504 for retaining barrel bushing 300, and wrench flats 506 for providing purchase for a wrench or other tool for installing or removing suppressor adaptor 502. If slide 102 is in place when swapping out the suppressor adaptor for the thread protector, the barrel bushing 300 is retained by the slide 102 so that the bushing and recoil spring remain captive. This allows for a fast, reliable changeover in the field.

Figure 8B:
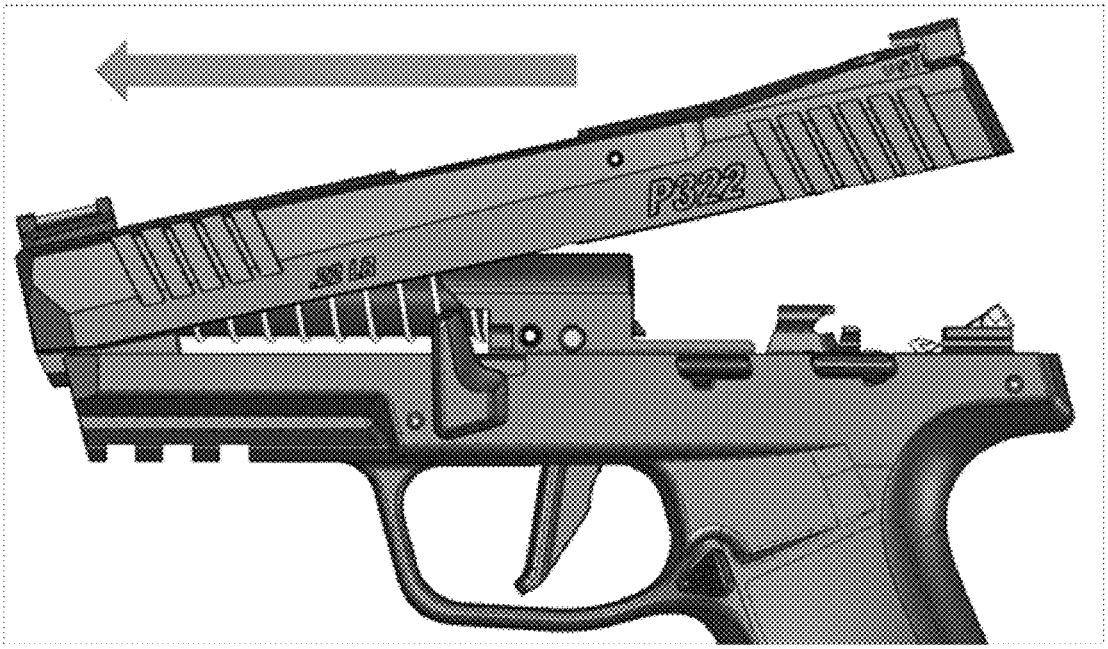
Figure 8C:
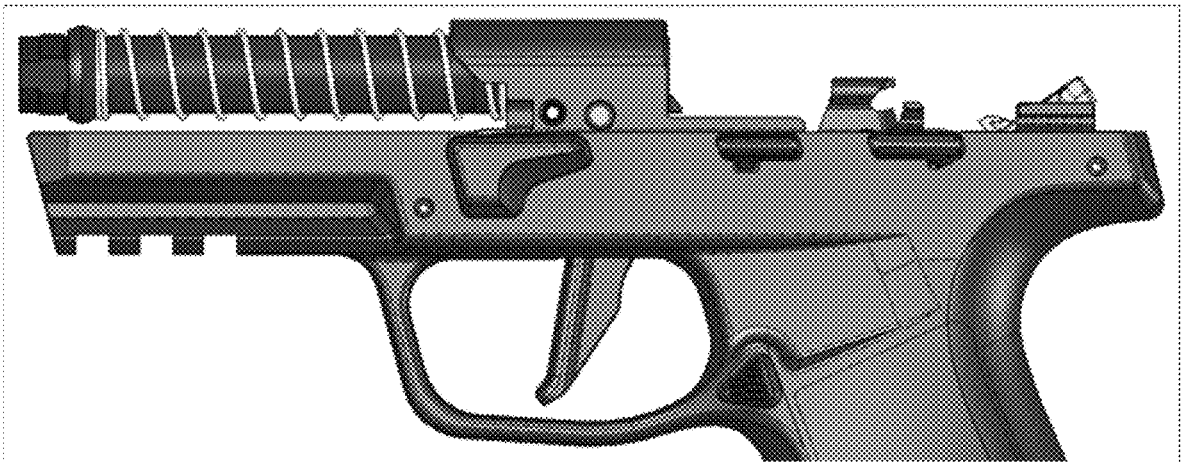
Figure 8D:
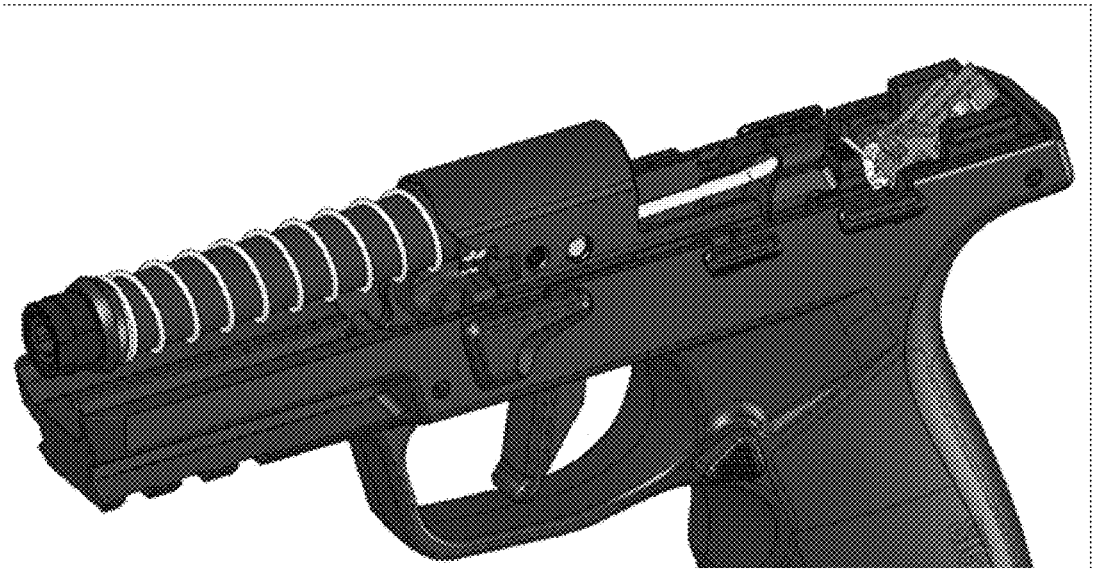

FIGS. 8A through 8D illustrate how the system described herein can facilitate the disassembling (field stripping) of the firearm. In FIG. 8A, the takedown lever is released, the slide and barrel bushing are pulled back, and the rear of the slide is released. While the slide remains in contact with the barrel bushing, the rear of the slide is rotated upward as shown. In FIG. 8B the rear of the slide has been rotated upwardly to an angle where the rear of the slide can clear the barrel, and the slide has been released forward so that the barrel opening in the front of the slide has cleared the end of the bushing stop. The bushing stop stops the advancement of the barrel bushing, but the slide is free to continue as it is not connected to the barrel bushing and is dimensioned to clear the bushing stop. FIGS. 8C and 8D provide views of the handgun after the slide has been removed. The recoil spring and barrel bushing remain captive, and the handgun is ready for cleaning and lubricating. The slide can be installed by reversing the above steps. If the operator wishes to remove the recoil spring, the bushing stop can be unscrewed from the barrel allowing the barrel bushing and recoil spring to be released.

EXAMPLES

The following examples pertain to embodiments of the present disclosure, from which numerous permutations and configurations will be apparent.

In one example a firearm includes a barrel connected to a frame, a slidable bushing mounted on the barrel, a bushing stop and a slide in contact with the bushing. The bushing is not connected to the frame.

Example 2 includes the subject matter of Example 1 and the slide and bushing are constructed and arranged such that the slide can pivot up and down without losing contact with the bushing.

Example 3 includes the subject matter of Examples 1 or 2 wherein the bushing is ring shaped and includes a convex surface that contacts the slide.

Example 4 includes the subject matter of Examples 1-3 wherein the bushing is retained on a distal end of the barrel by a bushing stop connected to the barrel.

Example 5 includes the subject matter of Examples 1-4 wherein the bushing is retained on the proximal end of the barrel by a recoil spring.

Example 6 includes the subject matter of Examples 1-5 wherein the bushing contacts the slide at a position on the bushing where the surface is convex and a position on the slide where the surface is an interior surface of a cone.

Example 7 includes the subject matter of Examples 1-6 wherein the convex surface is a spherical segment.

Example 8 includes the subject matter of Examples 1-7 wherein the bushing comprises a ring having a substantially flat inner surface that contacts the outer surface of the barrel.

Example 9 includes the subject matter of Examples 1-8 wherein the bushing comprises a ring having an equatorial midline that divides the bushing into a distal portion and a proximal portion, the proximal portion of the bushing facing the rear of the firearm and the distal portion of the bushing facing the muzzle of the firearm.

Example 10 includes the subject matter of Examples 1-9 wherein an outer surface of the distal portion of the bushing is convex and contacts a feature on the slide.

Example 11 includes the subject matter of Examples 1-10 wherein the feature on the slide is a cone or partial cone.

Example 12 includes the subject matter of Examples 1-11 wherein an outer surface of the proximal portion of the bushing is symmetrical with the outer surface of the distal portion of the bushing.

Example 13 includes the subject matter of Examples 1-12 wherein the bushing is symmetrical about its equatorial midline.

Example 14 includes the subject matter of Examples 1-13 wherein the bushing is comprised of metal or polymer.

Example 15 includes the subject matter of Examples 1-14 wherein the bushing is comprised of steel, bronze, aluminum or a synthetic polymer.

Example 16 includes the subject matter of Examples 1-15 wherein the bushing has an internal diameter that is larger than an external diameter of the barrel.

Example 17 includes the subject matter of Examples 1-16 wherein the bushing stop comprises a portion having an outer diameter greater than an outer diameter of the barrel.

Example 18 includes the subject matter of Examples 1-17 wherein the bushing stop comprises a portion having an outer diameter equal to or less than a diameter of the barrel.

Example 19 includes the subject matter of Examples 1-18 wherein the bushing stop is threaded to the muzzle end of the barrel.

Example 20 includes the subject matter of Examples 1-19 wherein the firearm is a handgun.

Example 21 includes the subject matter of Examples 1-20 wherein the handgun comprises a frame and the frame is free of forward guide rails for guiding the slide.

Example 22 includes the subject matter of Examples 1-21 wherein the handgun includes rear guide rails that are less than one half the length of the slide.

Example 23 includes the subject matter of Examples 1-22 wherein the bushing is not connected to the frame and is held in contact with the slide by the biasing force of a recoil spring.

Example 24 is a method of disassembling a firearm that comprises rotating a takedown lever, pulling the slide backward in relation to the frame, rotating the rear of the slide upward while the front of the slide retains contact with a barrel bushing that is retained by, and slidable along, the barrel, allowing the slide to return forward with the slide in a position that is not parallel to the barrel, and removing the slide from the firearm while the barrel bushing and recoil spring are fully retained on the barrel.

Example 25 includes the subject matter of example 24 wherein the barrel bushing is retained by a bushing stop and the slide passes over the bushing stop.

Example 26 includes the subject matter of example 24 or 25 wherein the bushing provides a spherical surface and the slide provides a conical surface that receives the spherical surface, wherein the spherical surface rotates along the conical surface when the rear of the slide is rotated upwards.

Example 27 includes the subject matter of any of examples 24-26 wherein the rear of the slide is retained by two rails in the frame and the forward portion of the slide is retained only by the barrel bushing.

Example 28 includes any of the subject matter of examples 24-27 wherein the bushing stop is either a thread protector or an adaptor for a suppressor, a flash hider, a barrel weight or a compensator.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A firearm comprising:
- a barrel connected to a frame;
- a slidable ring shaped bushing mounted on the barrel, the bushing including a convex surface;
- a bushing stop attached to a muzzle end of the barrel;
- a recoil spring retaining the bushing on a proximal end of the barrel; and
- a slide in contact with the bushing at the convex surface.

2. The firearm of claim 1 wherein the slide and bushing are constructed and arranged such that the slide can pivot up and down without losing contact with the bushing.

3. The firearm of claim 1 wherein the bushing stop is a thread protector.

4. The firearm of claim 3 wherein the bushing stop comprises a first portion having an outer diameter greater than an outer diameter of the barrel.

5. The firearm of claim 4 wherein the bushing stop comprises a second portion having an outer diameter equal to or less than a diameter of the barrel.

6. The firearm of claim 1 wherein the bushing contacts the slide at a position on the bushing where the surface is convex and a position on the slide where the surface is conical.

7. The firearm of claim 1 wherein the convex surface is a spherical segment.

8. The firearm of claim 1 wherein the bushing comprises a ring having a substantially flat inner surface that contacts the outer surface of the barrel.

9. The firearm of claim 1 wherein the bushing comprises a ring having an equatorial midline that divides the bushing into a distal portion and a proximal portion, the proximal portion of the bushing facing the rear of the firearm and the distal portion of the bushing facing the muzzle of the firearm.

10. The firearm of claim 9 wherein an outer surface of the proximal portion is symmetrical with the outer surface of the distal portion.

11. The firearm of claim 9 wherein the bushing is symmetrical about its equatorial midline.

12. The firearm of claim 1 wherein the slide includes a feature in contact with the bushing, and the feature is a cone or partial cone.

13. The firearm of claim 1 wherein the bushing is comprised of metal or polymer.

14. The firearm of claim 13 wherein the bushing is comprised of steel, brass, aluminum or a synthetic polymer.

15. The firearm of claim 1 wherein the bushing has an internal diameter that is larger than an external diameter of the barrel.

16. The firearm of claim 1 wherein the bushing stop is threaded to the muzzle end of the barrel.

17. The firearm of claim 1 wherein the firearm is a handgun.

18. A handgun comprising:
- a barrel connected to a frame;
- a slidable ring shaped bushing mounted on the barrel, the bushing including a convex surface;
- a bushing stop attached to a muzzle end of the barrel; and
- a slide in contact with the bushing at the convex surface, wherein the frame is free of forward guide rails for guiding the slide.

19. The firearm of claim 18 wherein the handgun includes rear guide rails that are less than one half the length of the slide.

20. The firearm of claim 18 wherein the bushing is not connected to the frame and is held in contact with the slide by the biasing force of a recoil spring.

21. A method of disassembling a firearm comprising:
- rotating a takedown lever;
- pulling the slide backward in relation to the frame;
- rotating the rear of the slide upward while the front of the slide retains contact with a barrel bushing that is retained by, and slidable along, the barrel;
- allowing the slide to return forward with the slide in a position that is not parallel to the barrel; and
- removing the slide from the firearm while the barrel bushing and recoil spring are fully retained on the barrel.

22. The method of claim 21 wherein the barrel bushing is retained by a bushing stop and the slide passes over the bushing stop.

23. The method of claim 21 wherein the bushing provides a spherical surface and the slide provides a conical surface that receives the spherical surface, wherein the spherical surface rotates along the conical surface when the rear of the slide is rotated upwards.

24. The method of claim 21 wherein the rear of the slide is retained by two rails in the frame and the forward portion of the slide is retained only by the barrel bushing.

25. The method of claim 21 wherein the bushing stop comprises a thread protector or a suppressor adaptor.

* * * * *